US010036180B1

(12) United States Patent
Jansen

(10) Patent No.: US 10,036,180 B1
(45) Date of Patent: Jul. 31, 2018

(54) FENCE POST ANCHOR INSTALLATION SYSTEM

(71) Applicant: Mark Edward Jansen, Remer, MN (US)

(72) Inventor: Mark Edward Jansen, Remer, MN (US)

( * ) Notice: Subject to any disclaimer, the term of this patent is extended or adjusted under 35 U.S.C. 154(b) by 233 days.

(21) Appl. No.: 15/097,718

(22) Filed: Apr. 13, 2016

Related U.S. Application Data

(60) Provisional application No. 62/148,944, filed on Apr. 17, 2015.

(51) Int. Cl.
*E04H 17/26* (2006.01)
*E04H 12/22* (2006.01)
*E02D 5/80* (2006.01)

(52) U.S. Cl.
CPC ..... *E04H 17/263* (2013.01); *E02D 5/80* (2013.01); *E04H 12/2215* (2013.01)

(58) Field of Classification Search
CPC ..... E04H 17/08; E04H 17/20; E04H 17/22; E04H 17/26; E04H 17/263; E04H 12/20; E04H 12/22; E04H 12/2238; E04H 12/3353; E04H 12/226; E04H 12/2269; E04H 12/2276; E04H 12/2292
See application file for complete search history.

(56) References Cited

U.S. PATENT DOCUMENTS

| | | | | |
|---|---|---|---|---|
| 1,140,156 | A | 5/1915 | Hindmarsh | |
| 1,764,207 | A * | 6/1930 | Johnson | E04H 12/2215 52/151 |
| 2,264,493 | A * | 12/1941 | Werning | H01B 17/145 174/158 F |
| 3,159,248 | A | 12/1964 | Biehn | |
| 3,823,832 | A | 7/1974 | Cobb | |
| 4,429,849 | A * | 2/1984 | Maier | E04G 21/1833 248/156 |
| 5,649,690 | A | 7/1997 | Kilmer | |
| 6,053,281 | A * | 4/2000 | Murray | E04G 21/3223 182/113 |
| 9,487,967 | B2 * | 11/2016 | Anson | E04H 17/10 |
| 9,506,210 | B2 * | 11/2016 | Southworth | E02B 7/02 |
| 9,732,540 | B1 * | 8/2017 | Jansen | E04H 17/22 |
| 2015/0292228 | A1 | 10/2015 | Bardelli et al. | |
| 2016/0298354 | A1 * | 10/2016 | Gauche | E04H 12/20 |
| 2017/0284118 | A1 * | 10/2017 | Southworth | E04H 7/02 |

* cited by examiner

*Primary Examiner* — Jonathan P Masinick
(74) *Attorney, Agent, or Firm* — William R. Berggren; Stephen F. Wolf; Berggren Law Offices, LLC

(57) ABSTRACT

A system of for installing unanchored fence post anchors with equidistant blades accurately with one or two persons comprising tools to align the fence post anchor while it is being urged into an anchored state.

12 Claims, 4 Drawing Sheets

FENCE POST ANCHOR INSTALLATION SYSTEM

FIELD OF THE INVENTION

This invention relates to a fence installation system and particularly to a fence post anchor installation system.

BACKGROUND OF THE INVENTION

There is a need for a fence post anchor installation system that allows one person to easily and precisely install fence post anchors.

Fence post anchors are used for fence posts that are not placed into cement in pre-dug holes but are affixed directly to the ground. The fence post anchors are parts of a fence post that are pressed into the ground and hold fence posts in place without the use of hardening agents such as cement in pre-dug holes on which fence posts are mounted. There are no tools or methods which currently exist to precisely hold a fence post anchor in place during the installation process. You are just jack hammering a free standing anchor into the ground allowing it to move in any direction.

There still is a need for a fence post anchor installation system that is allows one person to easily, accurately, and quickly install fence post anchors.

SUMMARY OF THE INVENTION

I have invented a system of tools for accurately installing a fence post anchor having equidistant blades with one or two persons. The system for installing a fence post anchor has two aspects, an article aspect and a method aspect. The article aspect, a fence post anchor installation system, comprises three elements, a vertical support element, a lower plate, and a first brace. The first element, the vertical support element. comprising an adjustable length, a bottom, a top and an upper portion. The second element, the lower plate, has a top surface, a perimeter, two parts releasably affixed together, and an edge region. The lower plate is affixed at the edge region to the bottom of the vertical support element, is made of a durable material, and extends outward from the vertical support element such that the perimeter of the lower plate is configured to encompass an unanchored anchor having (1) a substantially horizontal top configured to receive a fence post, (2) a bottom drawn toward a point, and (3) sides comprising blades expanding outward from its bottom when the anchor is in the ground adjacent to the vertical support element at a pre-determined location of a fence post anchor. The surface of lower plate has a first alignment opening with a first center configured to receive the blades of an unanchored anchor. The third element, the first brace element, has a first end, a second, and an adjustable length encompassed by a first vertical plane parallel to a vertical plane that contains a planned fence line that contains the fence post anchor, the first end releasably affixed to the vertical support element.

I have also invented a method aspect. The method of installing a fence post anchor comprises eight steps. The first step is providing an unanchored fence post anchor with a bottom having equidistant blades and a top receptacle. The unanchored anchor is anchored along a predetermined fence line encompassed by a first vertical plane over a series of fence post locations on ground comprising the planned fence line. The second step is providing a fence post anchor installation system as described above. The third step is releasably affixing the vertical support element to the lower plate such that the first alignment center is over the predetermined location of the unanchored fence post anchor. The fourth step is releasably affixing the first brace to the vertical support element and to the ground to hold the vertical support element substantially within the second vertical plane perpendicular to the first vertical plane. The fifth step is holding the vertical support element so it is substantially within the first vertical plane. The sixth step is placing the unanchored anchor with an extension post in its receptacle in the first alignment opening. The seventh step is urging the unanchored anchor into the ground of the anchor location. The eighth step is removing the lower plate from around the nearly anchored fence post anchor. The ninth step is finishing urging the unanchored anchor to become an anchored fence post anchor.

There are no tools or methods which currently exist to precisely hold a fence post anchor in place during the installation process. You are just jack hammering a free standing anchor into the ground allowing it to move in any direction. My invention assures a much more accurate installation of fence post anchors along with time savings. With my tool you can maintain the correct distance between anchors, locate and keep the anchor a precise distance from the property line, and keep the anchor vertically level in both directions and aligned during installation. You also create a level of consistency with each anchor that you cannot achieve with existing devices. Current methods allow the anchor to move in any direction while being hammered into the ground.

BRIEF DESCRIPTION OF THE DRAWINGS

One or more features or preferred forms of the invention are described in the accompanying drawings. The drawings are described briefly below.

Figure 1A:
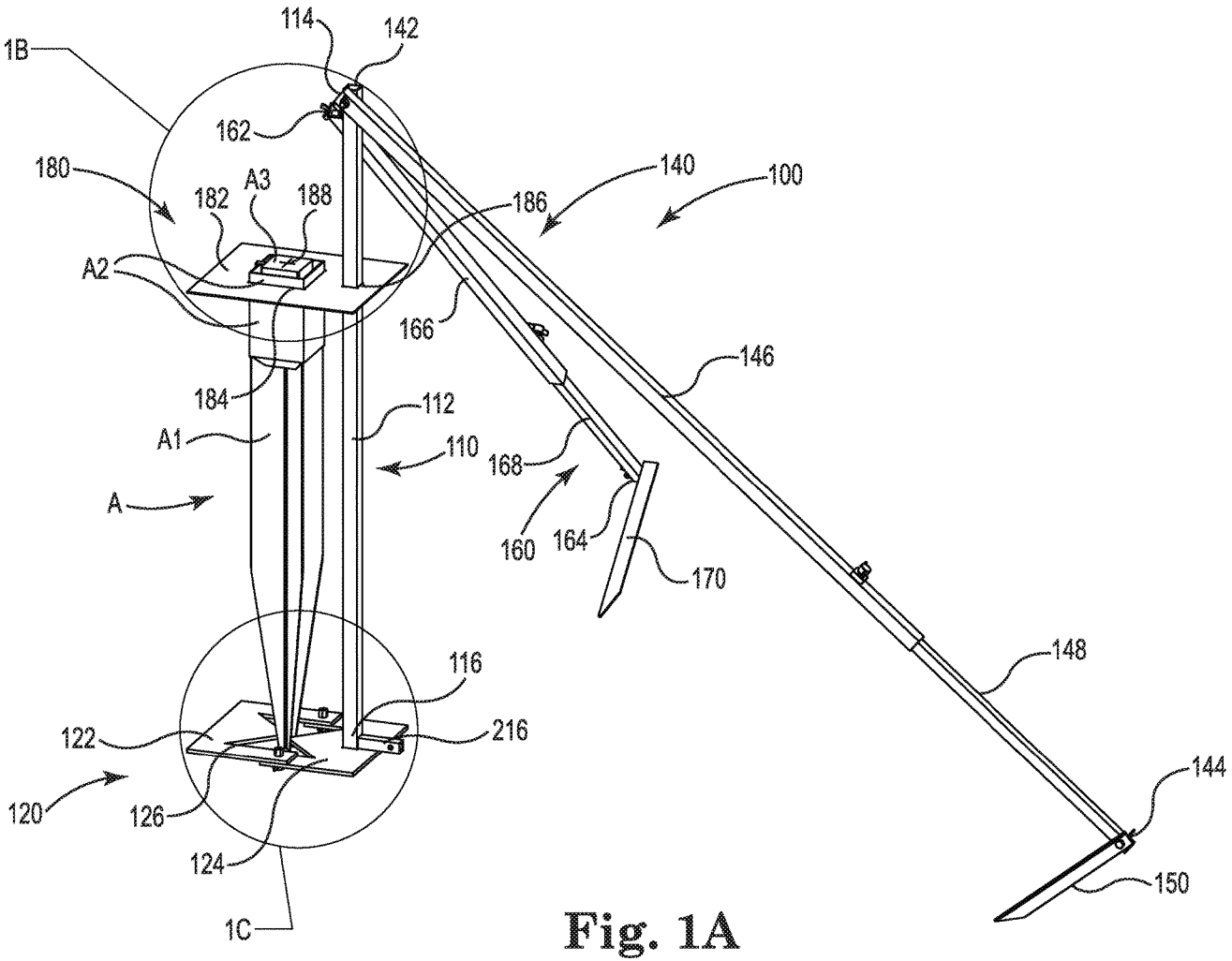
FIG. 1A is an illustration of an embodiment of the invention used for installing an unanchored fence post anchor and an embodiment of an unanchored fence post anchor with a receptacle filled with a post-like extension.

While the invention is amenable to various modifications and alternative forms, specifics thereof have been shown by way of example in the drawings and will be described in detail below. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF SOME EMBODIMENTS OF THE INVENTION

My invention is a Do-It-Yourself Fence Post Anchor Installation System that enables one or two people to install a series of fence posts anchors uphill, downhill, or on a flat surface with accuracy and efficiency. It only takes one or two people to use my components and methods to install fence posts anchors. In one embodiment, my system and tools enable just one person to accurately and quickly install fence post anchors uphill, downhill, or on flat grade.

In addition, my product is the most accurate, precise, simple, and fast way to install fence post anchors. Fencing contractors can cut their labor costs in half or more and also increase accuracy. As a lifelong homebuilder I originally designed my product and process to be used by fencing contractors, but realized how simple it was to use and how easily a single home owner installer could benefit from some embodiments of my tools and system.

Fence post anchors are used for fence posts that are not placed into cement in pre-dug holes but are affixed directly to the ground. The fence post anchors are parts of a fence post that are pressed into the ground and hold fence posts in place without the use of hardening agents such as cement in pre-dug holes on which fence posts are mounted. There are no tools or methods that currently exist to precisely hold a fence post anchor in place during the installation process. You are just jack hammering a free standing anchor into the ground allowing it to move in any direction. Current methods allow the anchor to move in any direction while being hammered into the ground.

Also installing fence post anchors on any type of grade currently requires at least 2 people and is very difficult to do accurately and quickly. Typically sections of a fence may go up hill, downhill or be on a flat surface. The installed posts that are placed in fence post anchors must be special aligned to permit installation of panels or fence slats supported by horizontal beams that ate affixed to fence posts set at regular distances. The posts must be level, vertically aligned both with the neighboring post and at right angles to the post to permit proper in subsequent attachment of fence panels or slats. In addition, the posts must be spaces properly to permit the subsequent panel or slat installation to occur to provide a fence that is bout function al and visually appealing. Currently this requires at least two people to measure, level, align, and brace the posts in the fence post anchors using only existing hand tools. The posts in the anchors are constantly being moved, re-aligned, and re-leveled, and the braces are constantly being adjusted to hold the posts in a desired position thus weakening the secure placement of the fence post anchor. There is a need for a system that permits accurate fence post anchor installation in an easier manner, preferably by only one person that minimizes the need for subsequent movement of the anchor to properly align the fence posts for successful installation of fence panels.

I have invented a system that does that. In addition, it allows fence post anchors to be installed more quickly than they are currently, and is suitable for a range of fence post anchor sizes suitable for anchoring fence posts having a variety of cross-sectional dimensions. Fence post anchors commonly comprise a blade portion including four blades equidistant from each other that decrease in width to a point and a receptacle top portion that is slightly larger than the bottom of a fence post that the receptacle will contain. Currently fence posts that use anchors typically have square cross-sections with widths that range from under 3 inches to over 6 inches. My invention may work for fence posts having other dimensions with appropriate tailoring of the size of the receptacle. Similarly, although fence post anchors typically have bottoms with four blades as discussed above, my system may be used to install anchors with bottoms of other configurations with appropriate alterations in the lower plate opening to accommodate different configurations.

My system is configured to easily and accurately align fence post anchors in both vertical planes (along a planned fence post line and transverse from that direction), brace anchors in both directions, align an anchor with neighboring anchored anchors, locate anchors the precise distance off the property line, and measure the exact distance between anchors for subsequent precise fence post and fence panel installation. In addition, the level of consistency with each anchor that is not possible with existing devices. The system is used with conventional tools such as levels, measuring tapes and hammers or jack hammers to achieve desired alignment. In addition, with some embodiments, this may be easily done by 1 person.

Specifically, I have invented a system of tools for installing a fence post anchor. The fence post anchors commonly are made of durable materials such as metal. Similarly, the tools of the invention are made of durable materials such as metals, plastics, or composites that have suitable strength and endurance for the job.

The article aspect, a fence post anchor installation system, comprises three elements, a vertical support element, a lower plate, and a first brace element. The first element, the vertical support element comprising an adjustable length, a bottom, a top, and an upper portion. The second element, the lower plate, has a top surface, a perimeter, two parts releasably affixed together, and an edge region. The lower plate is affixed at the edge region to the bottom of the vertical support element, is made of a durable material, and extends outward from the vertical support element such that the perimeter of the lower plate is configured to encompass an unanchored anchor having (1) a substantially horizontal top configured to receive a fence post, (2) a bottom drawn toward a point, and (3) sides comprising blades expanding outward from its bottom when the anchor is in the ground adjacent to the vertical support element at a pre-determined location of a fence post anchor. The surface of lower plate has a first alignment opening with a first center configured to receive the blades of an unanchored anchor. The third element, the first brace element, has a first end, a second, and an adjustable length encompassed by a first vertical plane parallel to a vertical plane that contains a planned fence line that contains the fence post anchor, the first end releasably affixed to the vertical support element. This first brace element is configured to hold the fence post anchor system vertically in a second vertical plane that is perpendicular the first vertical plane. It is understood that the first vertical plane may also refer to the vertical plane perpendicular to the vertical plane that encompasses the fence line and the second vertical plane may refer to the vertical plane parallel to the vertical plane that contains the planned fence line. The following discussion will refer to the first plane as parallel to the fence line.

The fence post anchor installation system may be held vertically in both vertical planes with a second person holding the system vertically in the first vertical plane.

Some embodiments of the fence post anchor system further include another element. The additional element is a second brace element. It has a first end, a second end, and an adjustable length in a second vertical plane substantially perpendicular to the first vertical plane. The first end is affixed to the vertical support element, and the second end is affixed to the ground. This permits alignment of the fence post anchor in both the first vertical plane and the second vertical plane without the need of a second person.

Some embodiments of the fence post anchor system further include an alignment rod where an unanchored fence post anchor is adjacent to an anchored fence post in the planned fence line. The alignment rod has a first end, a second end, and an adjustable length encompassed by the first vertical plane parallel to a plane that contains a planned fence line that contains the anchored fence post anchor. The first end is releasably in communication with the vertical support element and the second end in communication with the anchored anchor. In some embodiments, the alignment is configured to be horizontal. In some embodiments, an attachment bar is affixed to the lower plate adjacent the first alignment opening and configured to releasably attach to the first end of the alignment rod. In some embodiments, the second end has a notch that is configured to releasably attach to the top edge to the anchored anchor receptacle.

In some embodiments, the fence post anchor installation system further comprises an additional element, an upper plate to more securely hold the unanchored anchor in a vertically aligned position during installation. The upper plate has a top surface, a top surface, a perimeter, and an edge region. The upper plate is affixed at the edge region to the upper region of the vertical support element and made of a durable material. It extends outward from the vertical support element such that the perimeter of the upper plate is configured to encompass a fence post receptacle affixed to the fence post anchor when the fence post anchor is in the ground adjacent to the vertical support element at a predetermined location of a fence post anchor. The surface of upper plate has a second alignment opening of a size configured to receive the fence post anchor and a second center that is vertically above the first center of the first alignment opening of the lower plate.

In some embodiments, the fence post anchor installation system may have second alignment openings with different dimensions. As discussed earlier, fence post anchors with blades may have receptacles that are square with a cross-section distance of from 2 inches to over six inches to accommodate fence posts with square cross-sectional widths of slightly less than that of the receptacle. Typically the widths range from less than about 4 inches to more than six inches, The article aspect of the invention is made of strong durable materials that permit secure accurate alignment of the fence post anchor during installation. This may include metal, plastic, or composites that have sufficient strength, stiffness, and durability to remain functional during use.

The system may be better understood through use of several illustration s showing several embodiments of the invention. FIG. 1A is an illustration of an embodiment of the invention used for installing an unanchored fence post anchor and an embodiment of an unanchored fence post anchor with a receptacle filled with a post-like extension. An embodiment of a fence post anchor installation system (100) is shown with a vertical support element (110) that includes a length (112), a top (114), and a bottom (116). Although length 112 is shown as fixed, it may be adjustable in some embodiments. Also shown is a lower plate (120) with a surface (122), a perimeter, two parts releasably affixed together (124, 126), an edge region that is affixed to bottom 116 of vertical support element 110, and a first alignment opening (126) configured to receive blades (A1) of a fence post anchor (A). An attachment bar (216 is shown affixed to lower plate 122. A first brace (140) is shown with a first end (142) releasably affixed to top 114 of vertical support element 110, a first length section (146) slideably affixed to a second length section (148), and a second end (144) pivotally affixed to a first anchoring blade (150). A second brace (160) is shown with a first end (162) releasably affixed to top 114 of vertical support element 110, a first length section (166) slideably affixed to a second length section (168), and a second end (164) pivotally affixed to a second anchoring blade (160). An upper plate (180) having a surface (182), a second alignment opening (184) with a second center (188), and an edge region (186) releasably affixed to the upper portion of vertical support element 110. Anchor A is shown with a filler post (A3), typically a wooden fence post segment, in the anchor receptacle (A2) to assist urging the anchor into the ground by providing a better surface to apply force.

Figure 1D:
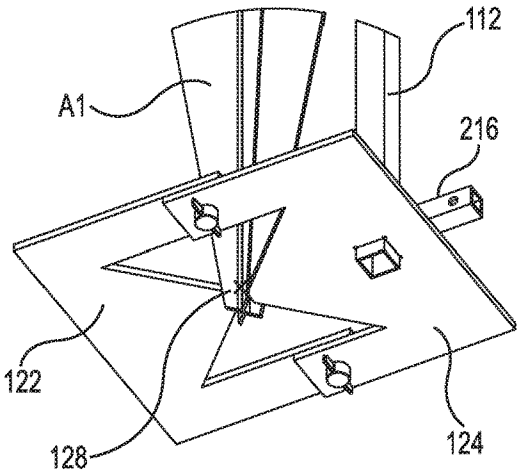
FIG. 1D is an illustration of the embodiment of FIG. 1A showing the lower plate of the system with the bottom of the unanchored anchor.
Figure 1C:
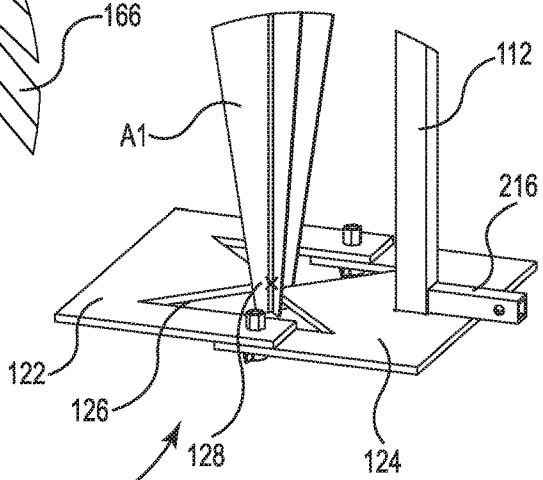
FIG. 1C is an illustration of the embodiment of FIG. 1A showing the lower plate of the system with the bottom of the unanchored anchor.
Figure 1B:
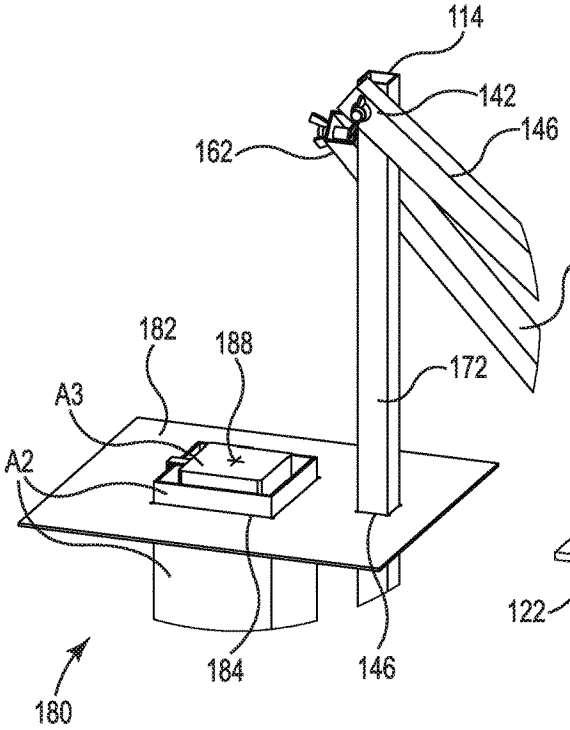
FIG. 1B is an illustration of the embodiment of FIG. 1A showing the upper plate of the top of the system with the top of the unanchored anchor.

FIG. 1B is an illustration of the embodiment of FIG. 1A showing the upper plate of the top of the system with the top of the unanchored anchor.

FIG. 1C is an illustration of the embodiment of FIG. 1A showing the lower plate of the system with the bottom of the unanchored anchor. A first center (128) of first alignment opening 126 is more clearly shown.

FIG. 1D is an illustration of the embodiment of FIG. 1A showing the lower plate of the system with the bottom of the unanchored anchor.

Figure 2C:
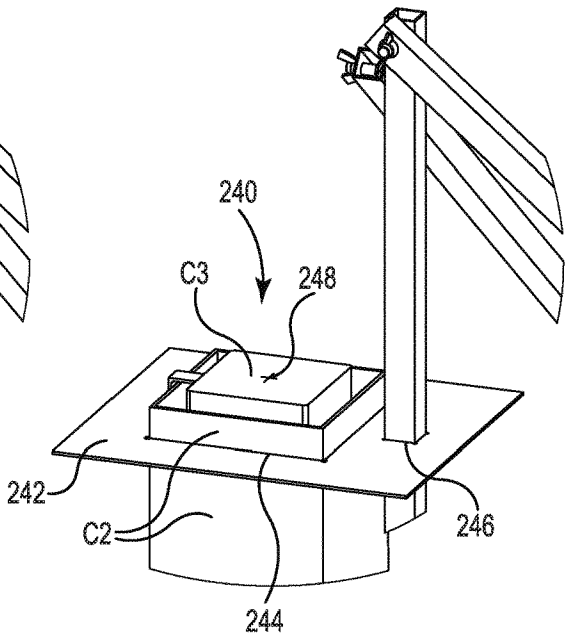
FIG. 2C is an illustration of an embodiment of the invention showing the upper plate of the top of the system with still another differently sized second alignment opening to accommodate a differently sized anchor receptacle.
Figure 2B:
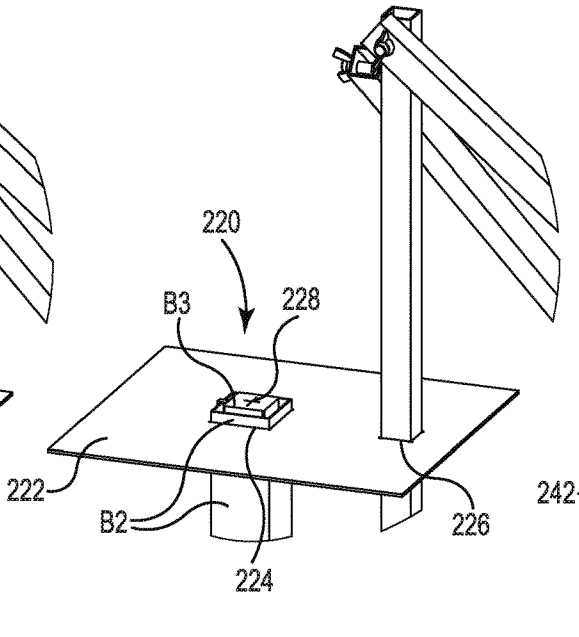
FIG. 2B is an illustration of an embodiment of the invention showing the upper plate of the top of the system with a differently sized second alignment opening to accommodate a differently sized anchor receptacle.
Figure 2A:
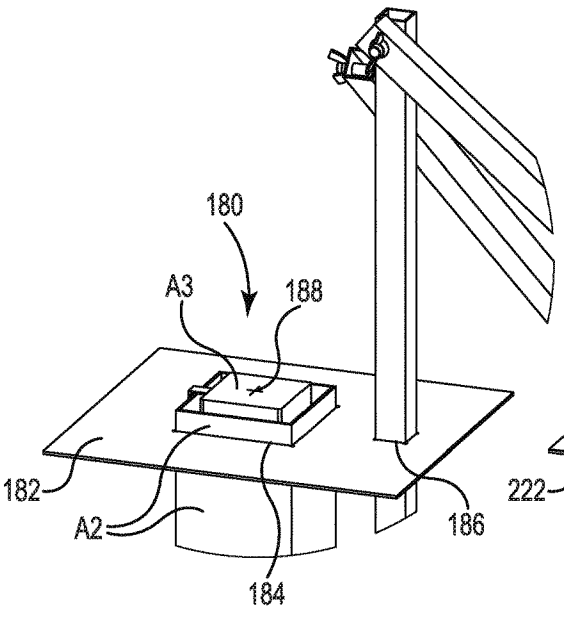
FIG. 2A is an illustration of an embodiment of the invention showing the upper plate of the top of the system with the top of an unanchored anchor containing a post shaped element to assist installation of the anchor.

FIG. 2A is an illustration of an embodiment of the invention showing the upper plate of the top of the system with the top of an unanchored anchor containing a post shaped element to assist installation of the anchor. This illustration is similar to that of FIG. 1B with the size of second alignment opening 184 being in the middle of the range of sizes needed to accommodate mid-level sized anchors.

FIG. 2B is an illustration of an embodiment of the invention showing the upper plate of the top of the system with a differently sized second alignment opening to accommodate a differently sized anchor receptacle. The size of second alignment opening 284 being in the lower range of sizes needed to accommodate small sized anchors (B).

FIG. 2C is an illustration of an embodiment of the invention showing the upper plate of the top of the system with still another differently sized second alignment opening to accommodate a differently sized anchor receptacle. The size of second alignment opening 384 being in the larger range of sizes needed to accommodate large sized anchors (C).

Figures 3A, 3B:
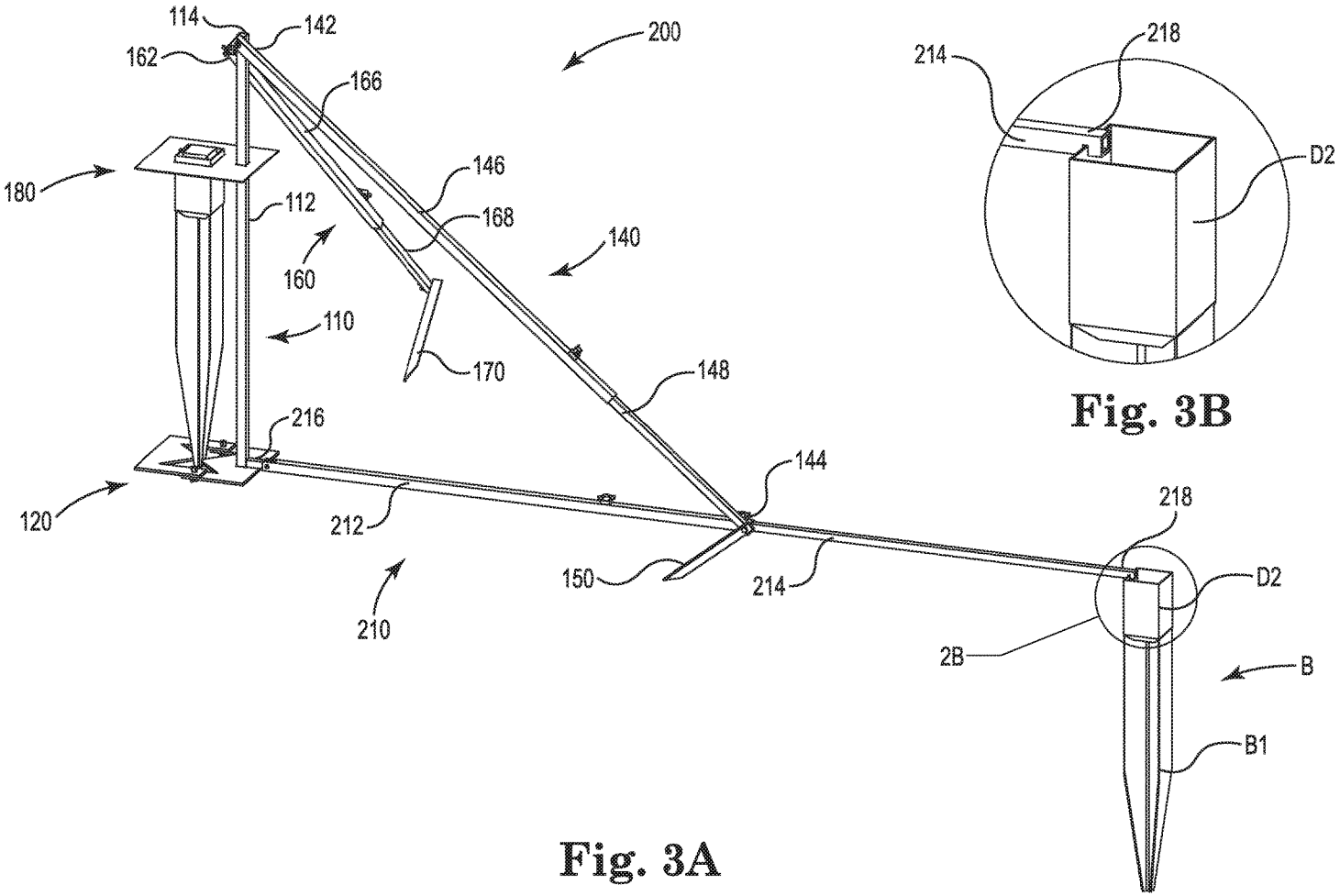
FIG. 3A is an illustration another embodiment of the invention used for installing an unanchored fence post anchor next to an adjacent anchored anchor and an embodiment of both an unanchored fence post anchor with a receptacle filled with a post-like extension and an anchored fence post anchor.
FIG. 3B is an illustration of the embodiment of FIG. 3A showing a close-up of a alignment rod releasably affixed to the top of the receptacle of the anchored anchor.

FIG. 3A is an illustration another embodiment of the invention used for installing an unanchored fence post anchor next to an adjacent anchored anchor and an embodiment of both an unanchored fence post anchor with a receptacle filled with a post-like extension and an anchored fence post anchor. FIG. 3A illustrated the embodiment of FIG. 1A with the addition of an anchored fence post anchor (D) with blades (D1), receptacle (D2) and a filler post (D3) and an alignment rod (210). Alignment rod 210 is shown with a first length (212) slideably engaged with a second length (214). One end is releasably affixed to attachment bar 216 and the other end (218) is flexibly engaged to the edge of anchored anchor receptacle D2.

FIG. 3B is an illustration of the embodiment of FIG. 3A showing a close-up of a alignment rod releasably affixed to the top of the receptacle of the anchored anchor.

I have also invented a method aspect. The method of installing a fence post anchor comprises nine steps. The first step is providing an unanchored fence post anchor with a bottom with equidistant blades and a top receptacle, the unanchored anchor to be anchored along a predetermined fence line encompassed by a first vertical plane over a series of fence post locations on ground comprising the planned fence line. The second step is providing the fence post anchor installation system described above comprising a vertical support element, a lower plate, and a first bracing element as described above. The third step is releasably affixing the vertical support element to the lower plate such that the first alignment center is over the predetermined location of the unanchored fence post anchor. The fourth step is releasably affixing the first brace to the vertical support element and to the ground to hold the vertical support element substantially within the second vertical plane perpendicular to the first vertical plane. The fifth step is holding the vertical support element so it is substantially within the first vertical plane. The sixth step is placing the unanchored anchor with an extension post in its receptacle in the first alignment opening. The seventh step is urging the unanchored anchor into the ground of the anchor location. The eighth step is removing the lower plate from around the nearly anchored fence post anchor. The ninth step is finishing urging the unanchored anchor to become an anchored fence post anchor.

In some embodiments of the method, the fence post anchor installation system includes a fourth element and the fifth step is further changed. The fourth element includes a second brace element with a first end, a second end, and an adjustable length in a second vertical plane substantially perpendicular to the first vertical plane, the first end is affixed to the vertical support element, and the second end is affixed to the ground. The fifth step is further modified in that the action of holding in place is by releasably affixing the second brace to the vertical support element and to the ground to hold the vertical support element substantially within the first vertical plane without the need for a second person to hold the vertical support element in place.

In some embodiments of the method, the fence post anchor installation system includes another element added to the three previously mentioned in the first method discussed above and the method includes two additional steps, a tenth step and an eleventh step after the third step previously discussed. The additional element is an alignment rod with a first end, a second end, and an adjustable length encompassed by the first vertical plane parallel to a plane that contains a planned fence line that contains the anchored fence post anchor. The first end is releasably in communication with the lower plate and the second end is in communication with the anchored anchor. The tenth step is providing an adjacent anchored fence post anchor within the planned fence. The eleventh step is positioning the alignment rod between the vertical support element and the adjacent anchored fence post anchor to obtain a desired distance between the unanchored fence post anchor and the adjacent fence post anchor.

In some embodiments of the method just discussed, the fence post anchor installation system includes another element added to the four just mentioned. The additional element an attachment bar affixed to the lower plate adjacent the first alignment opening and configured to releasably attach to the first end of the alignment rod to provide a more secure attachment of the alignment rod to the lower plate.

In some embodiments of the method, the fence post anchor installation system includes another element added to the three previously mentioned in the first method discussed above and the method includes two additional steps added to the nine steps in the first method discussed above. The additional element is an upper plate with a top surface, a top surface, a perimeter, and an edge region. The upper plate is (1) affixed at the edge region to the upper region of the vertical support element, (2) made of a durable material, and (3) extends outward from the vertical support element such that the perimeter of the upper plate is configured to encompass a fence post receptacle affixed to the fence post anchor when the fence post anchor is in the ground adjacent to the vertical support element at a pre-determined location of a fence post anchor. The surface of upper plate has a second alignment opening of a size configured to receive the fence post and a second center that is vertically above the first center of the first alignment opening of the lower plate. The first additional step is selecting the upper plate with the desired alignment opening size to fit the receptacle of the unanchored. The second additional step is placing the unanchored anchor through the alignment opening to achieve a more stable vertical alignment of the unanchored anchor as it is urged into the ground. In some embodiments, more that one of the above discussed embodiments of the method aspect may be combined.

Other modifications and changes regarding my invention will be apparent to those skilled in the art. The invention is not considered limited to the embodiments chosen for purposes of disclosure and covers all changes and modifications that do not constitute departures from the true spirit and scope of this invention.

I claim:

1. A fence post anchor installation system comprising:

a vertical support element comprising an adjustable length, a bottom, a top and an upper portion;

a lower plate with a top surface, a perimeter, two parts releasably affixed together, and an edge region, the lower plate affixed at the edge region to the bottom of the vertical support element, made of a durable material, and extending outward from the vertical support element such that the perimeter of the lower plate is configured to encompass an unanchored anchor having a substantially horizontal top configured to receive a fence post, a bottom drawn toward a point, and sides comprising blades expanding outward from its bottom when the anchor is in the ground adjacent to the vertical support element at a pre-determined location of a fence post anchor, the surface of the lower plate having a first alignment opening with a first center configured to receive the blades of an unanchored anchor; and a first brace element with a first end, a second, and an adjustable length encompassed by a first vertical plane parallel to a vertical plane that contains a planned fence line that contains the fence post anchor, the first end releasably affixed to the vertical support element.

2. The fence post anchor installation system of claim 1 further comprising a second brace element with a first end, a second end, and an adjustable length in a second vertical plane substantially perpendicular to the first vertical plane, the first end affixed to the vertical support element, and the second end affixed to the ground.

3. The fence post anchor installation system of claim 1, wherein the unanchored anchor is adjacent to an anchored fence post anchor in the first vertical plane that is parallel to the plane that contains the planned fence line and the system, further comprises an alignment rod with a first end, a second end, and an adjustable length encompassed by the first vertical plane parallel to a plane that contains a planned fence line that contains the anchored fence post anchor, the first end releasably in communication with the vertical support element and the second end in communication with the anchored anchor.

4. The fence post anchor installation system of claim 3, wherein the alignment rod is configured to be horizontal.

5. The fence post anchor system of claim 3 further comprising an attachment bar affixed to the lower plate adjacent the first alignment opening and configured to releasably attach to the alignment tool.

6. The fence post anchor installation system of claim 1 further comprising an upper plate with a top surface, a perimeter, and an edge region, the upper plate affixed at the edge region to the upper region of the vertical support element, made of a durable material, and extending outward from the vertical support element such that the perimeter of the upper plate is configured to encompass a fence post receptacle affixed to the fence post anchor when the fence post anchor is in the ground adjacent to the vertical support element at a pre-determined location of a fence post anchor, the surface of the upper plate having a second alignment opening of a size configured to receive the fence post anchor and a second center that is vertically above the first center of the first alignment opening of the lower plate.

7. The fence post anchor installation system of claim 6, wherein the second alignment opening is configured to have various sizes to accommodate fence post anchors with various sized receptacles.

8. A method of installing a fence post anchor comprising:

providing an unanchored fence post with a bottom with equidistant blades and a top receptacle, the unanchored anchor to be anchored along a predetermined fence line encompassed by a first vertical plane over a series of fence post locations on ground comprising the planned fence line;

providing a fence post anchor installation system comprising:

a vertical support element comprising an adjustable length, a bottom, a top and an upper portion;

a lower plate with a top surface, a perimeter, two parts releasably affixed together, and an edge region, the lower plate affixed at the edge region to the bottom of the vertical support element, made of a durable material, and extending outward from the vertical support element such that the perimeter of the lower plate is configured to encompass an unanchored anchor having a substantially horizontal top configured to receive a fence post, a bottom drawn toward a point, and sides comprising blades expanding outward from its bottom when the anchor is in the ground adjacent to the vertical support element at a pre-determined location of a fence post anchor, the surface of the lower plate having a first alignment opening with a first center configured to receive the blades of an unanchored anchor; and a first brace element with a first end, a second, and an adjustable length encompassed by a first vertical plane parallel to a vertical plane that contains a planned fence line that contains the fence post anchor, the first end releasably affixed to the vertical support element:

releasably affixing the vertical support element to the lower plate such that the first alignment center is over the predetermined location of the unanchored fence post anchor;

releasably affixing the first brace to the vertical support element and to the ground to hold the vertical support element substantially within the first vertical plane;

holding the vertical support element so it is substantially within the first vertical plane;

placing the unanchored anchor with an extension post in its receptacle in the first alignment opening;

urging the unanchored anchor into the ground of the anchor location;

removing the lower plate from around the nearly anchored fence post anchor; and finishing urging the unanchored anchor to become an anchored fence post anchor.

9. The method of installing a fence post anchor of claim 8, wherein the fence post anchor installation system further comprises a second brace element with a first end, a second end, and an adjustable length in a second vertical plane substantially perpendicular to the first vertical plane, the first end affixed to the vertical support element, and the second end affixed to the ground; and wherein holding the vertical support element comprises releasably affixing the second brace to the vertical support element and to the ground to hold the vertical support element substantially within the first vertical plane without the need for a second person to hold the vertical support element in place.

10. The method of installing a fence post anchor of claim 8, wherein the fence post anchor installation system further comprises an alignment rod with a first end, a second end, and an adjustable length encompassed by the first vertical plane parallel to a plane that contains a planned fence line that contains the anchored fence post anchor, the first end releasably in communication with the vertical support element and the second end in communication with the anchored anchor, and the method further comprises:

providing an adjacent anchored fence post anchor within the planned fence; and positioning the alignment rod between the vertical support element and the adjacent anchored fence post anchor to obtain a desired distance between the unanchored fence post anchor and the adjacent fence post anchor.

11. The method of installing a fence post anchor of claim 10, wherein the fence post anchor system further comprises an attachment bar affixed to the lower plate adjacent the first alignment opening and configured to releasably attach to the alignment rod.

12. The method of installing a fence post anchor of claim 8, wherein the fence post anchor installation system further comprises an upper plate with a top surface, a top surface, a perimeter, and an edge region, the upper plate affixed at the edge region to the upper region of the vertical support element, made of a durable material, and extending outward from the vertical support element such that the perimeter of the upper plate is configured to encompass a fence post receptacle affixed to the fence post anchor when the fence post anchor is in the ground adjacent to the vertical support element at a pre-determined location of a fence post anchor, the surface of the upper plate having a second alignment opening of a size configured to receive the fence post anchor and a second center that is vertically above the first center of the first alignment opening of the lower plate, and the method further comprises:

selecting the upper plate with the desired alignment opening size to fit the receptacle of the unanchored anchor;

placing the unanchored anchor through the alignment opening to achieve a more stable vertical alignment of the unanchored anchor as it is urged into the ground.

* * * * *